US007297191B1

(12) United States Patent
Miksic et al.

(10) Patent No.: US 7,297,191 B1
(45) Date of Patent: Nov. 20, 2007

(54) BIODEGRADABLE CORROSION INHIBITOR COMPOSITION

(75) Inventors: Boris A. Miksic, North Oaks, MN (US); Margarita Karshan, Little Canada, MN (US); Ashish Gandhi, St. Paul, MN (US)

(73) Assignee: Cortec Corporation, St. Paul, MN (US)

( * ) Notice: Subject to any disclaimer, the term of this patent is extended or adjusted under 35 U.S.C. 154(b) by 0 days.

(21) Appl. No.: 11/539,223

(22) Filed: Oct. 6, 2006

Related U.S. Application Data

(63) Continuation of application No. 10/661,794, filed on Sep. 12, 2003, now Pat. No. 7,118,615.

(51) Int. Cl.
*C23F 11/00* (2006.01)
*C09K 3/00* (2006.01)

(52) U.S. Cl. ..... 106/14.44; 106/14.13; 106/14.14; 106/14.15; 106/14.16; 252/388; 252/390; 252/392; 252/394; 252/396

(58) Field of Classification Search ..... 106/14.13, 106/14.15, 14.16, 14.18, 14.41, 14.42, 14.44, 106/14.14; 252/388, 390, 392, 394, 396
See application file for complete search history.

(56) References Cited

U.S. PATENT DOCUMENTS

| | | | | |
|---|---|---|---|---|
| 2,744,624 | A | 5/1956 | Hoogstoel et al. | |
| 3,018,015 | A | 1/1962 | Agriss et al. | |
| 3,142,599 | A | 7/1964 | Cavannes | |
| 3,231,454 | A | 1/1966 | Williams | |
| 3,769,145 | A | 10/1973 | Gresham et al. | |
| 4,017,351 | A | 4/1977 | Larson et al. | |
| 4,049,854 | A | 9/1977 | Casey et al. | |
| 4,132,735 | A | 1/1979 | Lamberti | |
| 4,344,536 | A | 8/1982 | Oberhuber | |
| 5,597,514 | A | 1/1997 | Miksic et al. | |
| 5,976,415 | A | 11/1999 | Scholl et al. | |
| 6,028,160 | A | 2/2000 | Chandler | |
| 6,085,905 | A | 7/2000 | Miksic et al. | |
| 6,156,929 | A | 12/2000 | Chandler et al. | |
| 6,617,415 | B1 | 9/2003 | Miksic et al. | |
| 6,787,065 | B1 | 9/2004 | Schapira et al. | |
| 7,118,615 | B1 * | 10/2006 | Miksic et al. | 106/14.16 |
| 2004/0029754 | A1 | 2/2004 | Wenderoth et al. | |

OTHER PUBLICATIONS

Derwent Abstract No. 1992-250785, abstract of German Patent Specification No. DD298663 A5 (Mar. 1992).*

* cited by examiner

*Primary Examiner*—Anthony J. Green
(74) *Attorney, Agent, or Firm*—Haugen Law Firm PLLP

(57) ABSTRACT

A corrosion inhibitor composition includes between about 95 and about 99 percent by weight ammonium benzoate, and between 1 and about 5 percent by weight of silica. The composition may be water soluble for use in solution-based applications.

2 Claims, No Drawings

BIODEGRADABLE CORROSION INHIBITOR COMPOSITION

CROSS-REFERENCE TO RELATED APPLICATION

This application is a continuation of U.S. patent application Ser. No. 10/661,794, filed Sep. 12, 2003, now U.S. Pat. No. 7,118,615, and entitled "BIODEGRADABLE CORROSION INHIBITOR COMPOSITION", the content of which is incorporated herein in its entirety.

FIELD OF THE INVENTION

The present invention relates to vapor phase corrosion inhibitor compositions generally, and more particularly to water-soluble vapor phase corrosion inhibitor compositions that are specifically formulated to provide enhanced corrosion inhibiting properties for application throughout a protected target.

BACKGROUND OF THE INVENTION

Vapor phase corrosion inhibitor materials have been utilized in a variety of applications for protecting typically metal devices or components thereof from vapor phase corrosion thereof. Conventional corrosion inhibitor materials are typically specifically adapted to protect particular metals. Further, such conventional corrosion inhibitor materials find difficulty in being universally applied in both solid and aqueous form, with such conventional materials displaying certain drawbacks in such applications.

For example, conventional inhibitor materials typically do not provide multi-targeted corrosion protection in a single composition. Further, such materials tend to lack the capability of creating a corrosion barrier upon contact with the targeted surface. Since corrosion inhibitor materials are often times utilized in applications where environmental sensitivity is critical, it is an important feature of such materials to be environmentally friendly, and preferably substantially biodegradable. A particular example of such an application is in the corrosion protection of corrosion-susceptible components in hydrotesting fluid conduits such as petroleum pipelines.

For example, in 1995, the Norwegian Pollution Control Authority (SFT) implemented the OSPAR Harmonized Offshore Chemical Notification format (HOCNF). Its primary function is to document and control the environmental properties of offshore chemicals. HOCNF documentation tracks chemical ingredients as well as toxicity, biodegradation and bioaccumulation testing data. SFT issues discharge permits. These permits enable the operating oil companies to change chemicals without additional permits provided that the environmental risks do not increase. These permits require the operator to gradually and systematically replace chemicals that have questionable environmental effects with less harmful products. All operators are held to the same strict discharge regulations.

The use of traditional petroleum oil based products and other hazardous chemicals has been under severe scrutiny. Oil based products not only pose hazards to the environment and the operators, but they also fail to perform well in applications such as hydrotesting. In addition many of these products are difficult to use and remove.

It is therefore a primary object of the present invention to provide a water-soluble corrosion inhibitor composition that is substantially biodegradable, and is adapted to be effective in protecting a variety of corrosion-susceptible materials.

It is a further object of the present invention to provide a water-soluble corrosion inhibitor composition which enables corrosion protection on contact with targeted surfaces of corrosion-susceptible materials.

It is a still further object of the present invention to provide a water-soluble corrosion inhibitor composition that is specifically adapted to be dissolved in water at a concentration of between about 0.25 percent and about 5 percent by weight without substantially altering the flowability characteristics of the water.

SUMMARY OF THE INVENTION

We have found that selected biodegradable chemicals can be utilized as a dry fogged vapor corrosion inhibition system or in a water solution for treating metallic surfaces of all kinds. When fogged into closed spaces that can be sealed, effective long-term protection is provided. The system can be easily removed with a water wash if needed. In other applications, spraying as little as a 1% solution in water is effective, and if sealed after treatment, will provide long-term protection against corrosion. The vapor-phase inhibiting action protects inaccessible and recessed surfaces, and if the vapor phase inhibition layer is distributed the layer is replenished by the continuous vapor redisposition.

In a particular embodiment of the present invention, a water-soluble corrosion inhibitor composition includes between about 90 and about 99 percent by weight ammonium benzoate, and one or more additive components in an amount of between about 1 and about 10 percent by weight of the composition. The one or more additive components are selected from the group consisting of silica, triazoles, and wetting agents.

Preferably, the corrosion inhibitor composition is adapted to be dissolved in water in an amount necessary to form an aqueous solution having about 0.25 to about 5 percent by weight of the corrosion inhibitor composition.

DETAILED DESCRIPTION OF THE PREFERRED EMBODIMENTS

The objects and advantages enumerated above together with other objects, features, and advances represented by the present invention will now be presented in terms of detailed embodiments. Other embodiments and aspects of the invention are recognized as being within the grasp of those having ordinary skill in the art.

EXAMPLE 1

Benzoic acid was reacted with $NH_3$ gas in a pressure vessel to produce the ammonium benzoate salt, which is the main component of the new systems.

| | |
|---|---|
| Ammonium Benzoate | 95% |
| Sodium sulfonate | 5% |

Sodium sulfonate is available, for example, from Akzo Nobel as Petro 22.

When the above composition is used as a 0.25% to 2% solution in water, a very effective corrosion inhibition wash system is produced. A 2-3% solution is preferably used during hydrotesting and for the preservation of internal surfaces on pipes and vessels. The addition of the 5% sodium sulfonate acts as a wetting agent and substantially increases the solubility of the ammonium benzoate.

EXAMPLE 2

| | |
|---|---|
| Ammonium Benzoate | 93% |
| Silica | 5% |
| Benzotriazole | 2% |

The benzotriazole is available from PMC Specialties Group. An especially suitable silica is available from Horton Earl Co as Sipernant 50 S.

Ammonium Benzoate mixed with silica and triazole to form a dry powder mix is particularly effective for fogging into closed spaces. The combination of silica to prevent clumping and triazole for non-ferrous metal protection provides multi-metal protection against corrosion. It can be easily removed with a water wash.

EXAMPLE 3

| | |
|---|---|
| Ammonium benzoate | 97.5% |
| Benzotriazole | 2% |
| S-5 | 0.5% |

S-5 is an imidazoline acetate available from Mona Industries as Monazoline "T".

The combination of ammonium benzoate, sodium triazole and a wetting agent such as S-5 was used at a 1-3% solution for engines and ballast tanks during shipping and storage.

EXAMPLE 4

| | |
|---|---|
| Ammonium benzoate | 95% |
| Silica | 5% |

A system especially suitable for fogging into closed spaces was prepared from by blending about 5% silica with ammonium benzoate. The silica is useful in preventing clumping when fogged in any process where humidity is a factor.

The compositions described in Examples 1 and 3 are particularly suitable for packaging in water soluble bags for ease of handling. Examples of such water soluable bags are disclosed in the U.S. Pat. Nos. 6,085,905 and 6,280,528, issued to the same assignee as in the present application.

The invention has been described herein in considerable detail in order to comply with the patent statutes, and to provide those skilled in the art with the information needed to apply the novel principles and to construct and use embodiments of the invention as required. However, it is to be understood that various modifications can be accomplished without departing from the scope of the invention itself.

What is claimed is:

1. A corrosion inhibitor composition consisting essentially of:

(a) between about 95 and about 99 percent by weight ammonium benzoate; and (b) between about 1 and about 5 percent by weight silica.

2. A corrosion inhibitor composition as in claim 1 that is adapted to be dissolved in water in an amount necessary to form an aqueous solution having about 0.25 to about 5 percent by weight of said corrosion inhibitor composition.

* * * * *